US005990431A

United States Patent [19]

Wright

[11] Patent Number: 5,990,431

[45] Date of Patent: Nov. 23, 1999

[54] PROTECTIVE COVER FOR ROCKER SWITCH

[75] Inventor: Jeffery R. Wright, Cazenovia, N.Y.

[73] Assignee: Marquardt Switches, Inc., Cazenovia, N.Y.

[21] Appl. No.: 09/080,775

[22] Filed: May 18, 1998

[51] Int. Cl.[6] ..... H01H 19/06

[52] U.S. Cl. ..... 200/302.3; 200/302.3

[58] Field of Search ..... 200/302.1, 302.2, 200/302.3

[56] References Cited

U.S. PATENT DOCUMENTS

| | | | |
|---|---|---|---|
| 4,345,121 | 8/1982 | Tenner | 200/42 R |
| 4,814,554 | 3/1989 | Magiera | 200/6 R |
| 5,568,861 | 10/1996 | Lamberti | 200/302.003 |
| 5,788,059 | 4/1998 | Jahangiri | 200/302.3 |

FOREIGN PATENT DOCUMENTS

| | | | |
|---|---|---|---|
| 1956502 | 11/1969 | Germany | 200/153 J |
| 0 653 769 B1 | 8/1994 | Germany . | |

*Primary Examiner*—M. L. Gellner
*Assistant Examiner*—Nhung Nguyen
*Attorney, Agent, or Firm*—Wall Marjama Bilinski & Burr

[57] ABSTRACT

A protective covering for a rocker switch that includes a bezel and a rocker arm passing upwardly through an opening in the bezel. An open frame is snap-fitted tightly over the bezel and contains a resilient cap that encloses the top of the frame and the upwardly extended rocker arm. The cap is bonded to the frame to provide a dirt-proof seal therebetween. The cap can be depressed against the rocker arm to cycle the switch without disturbing the seal.

6 Claims, 3 Drawing Sheets

PROTECTIVE COVER FOR ROCKER SWITCH

BACKGROUND OF THE INVENTION

This invention relates to apparatus for protectively covering a switch to prevent dirt and other contaminants from damaging the working parts of the switch without adversely effecting the operation of the switch. This invention relates more specifically to a protective cover for use in association with a rocker arm switch.

Some protective devices for rocker arm switches have been devised that involve internally located seals that operate well to protect the inner components of the switch from dirt, dust and the like. However, the externally exposed rocker arm can collect various contaminants which accumulate to a point where the rocker arm can no longer be cycled. This is particularly true where the switch is used in association with a power tool that produces chips, shavings and dust, such as a portable sanding machine.

Attempts also have been made to enclose rocker arm switches within a protective housing, however the housing typically will not furnish the flexibility needed to responsively cycle the switch. By the same token, creating a satisfactory positive seal between the housing and the switch itself is extremely difficult. Most tools, and particularly portable hand tools, are exposed to rather rough handling and, as a consequence, seals can be broken or dislodged, thereby defeating the protection afforded by the housing.

SUMMARY OF THE INVENTION

It is, therefore, an object of the present invention, to improve switches of the type employed in power tools and in particular, hand-held power tools.

A further object of the present invention is to provide a protective covering for the switch of a dirt producing power tool.

A still further object of the present invention is to provide a protective seal for a rocker arm switch that will not impede the response of the switch.

Another object of the present is to provide a collapsible outer cover for a rocker arm switch that forms a positive seal against the bezel of the switch.

These and other objects of the present invention are attained in association with a switch for a power tool having a bezel located at the top of the switch housing. A switch activator is mounted in the bezel with a portion of the activator protruding upwardly beyond the bezel so that the switch is manually engaged to cycle the switch. A rigid frame is tightly fitted over the bezel and a resilient cover is sealed to the frame that is capable of being collapsed against the activator to permit the switch to be cycled.

BRIEF DESCRIPTION OF THE DRAWINGS

For a better understanding of these, and other objects of the present invention, reference will be made to the detailed description of the invention below which should be read in association with the accompanying drawings, wherein.

DESCRIPTION OF THE INVENTION

Figure 1:
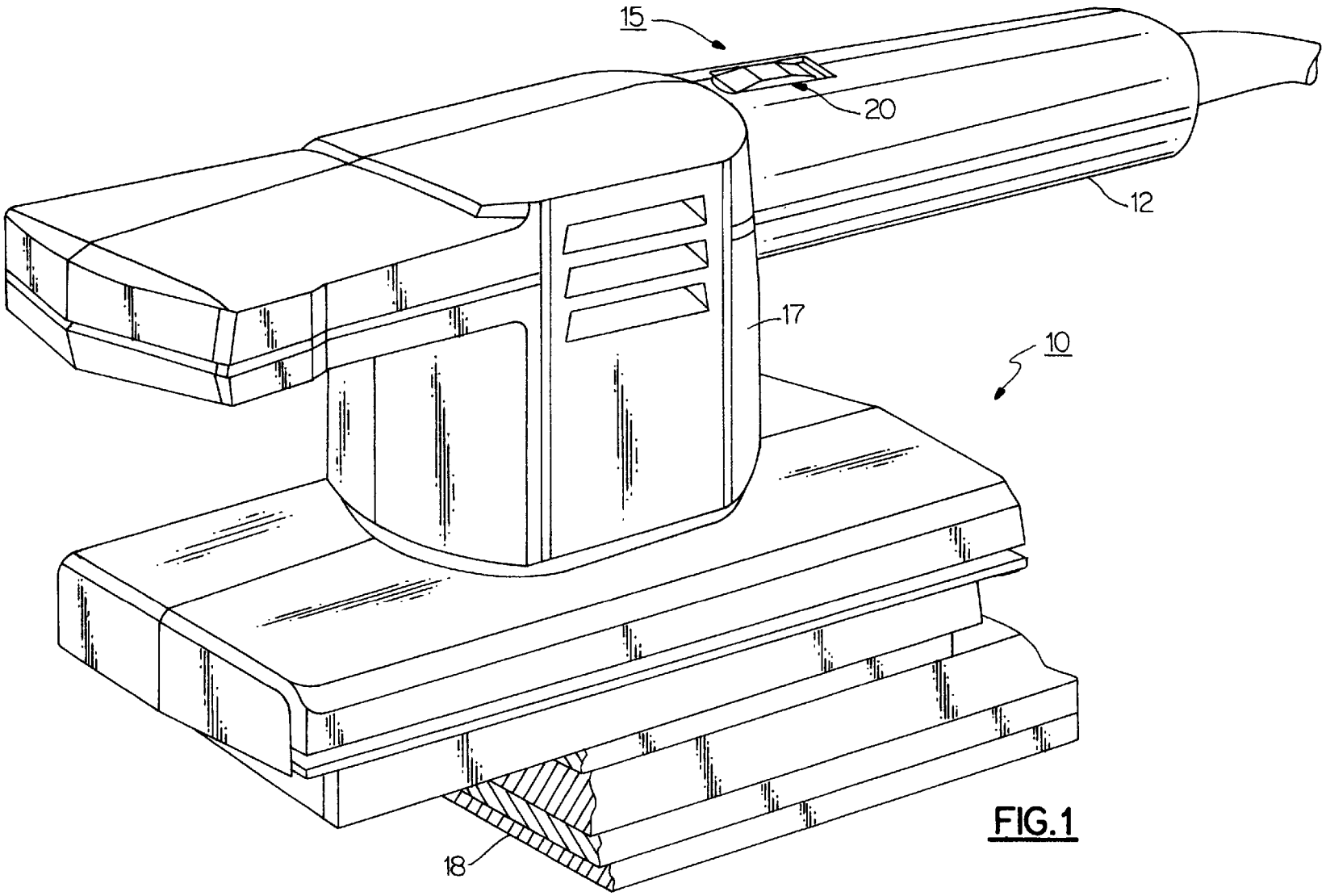
FIG. 1 a perspective view of a power tool containing a switch embodying the teachings of the present invention.

Turning now to the drawings, and in particular to FIG. 1, there is shown a portable hand tool 10 in the form of an electrical sander of the type used in workshops and the like. The sander includes a handle 12 containing a rocker arm switch, generally designated 15, that can be manually cycled by the operator to activate or deactivate an electrical motor enclosed within the motor housing 17. The motor, in turn, is coupled to a sanding pad 18 through means of an orbital drive mechanism (not shown). As is well known in the art, this type of hand tool is capable of generating a good deal of dust and dirt which can find its way into the switch where it can cause sufficient damage to render the switch, and thus the tool, inoperative. As will be explained in greater detail below, the present switch is equipped with a cover 20 that prevents dust, dirt and the like from entering the switch while at the same time, allowing the switch to be easily accessed and cycled.

Although the present invention will be described in conjunction with an orbital sander, it should be apparent from the description below that the switch embodying the invention can be employed in any number of electrical devices that are forced to operate in a dirt-filled environment. Similarly, although the protective covering described in further detail below is ideally suited for use in association with a rocker arm switch, it can be easily adapted for use with a number of switches that are cyclicable, such as a push button switch, to change the switch function.

Figure 2:
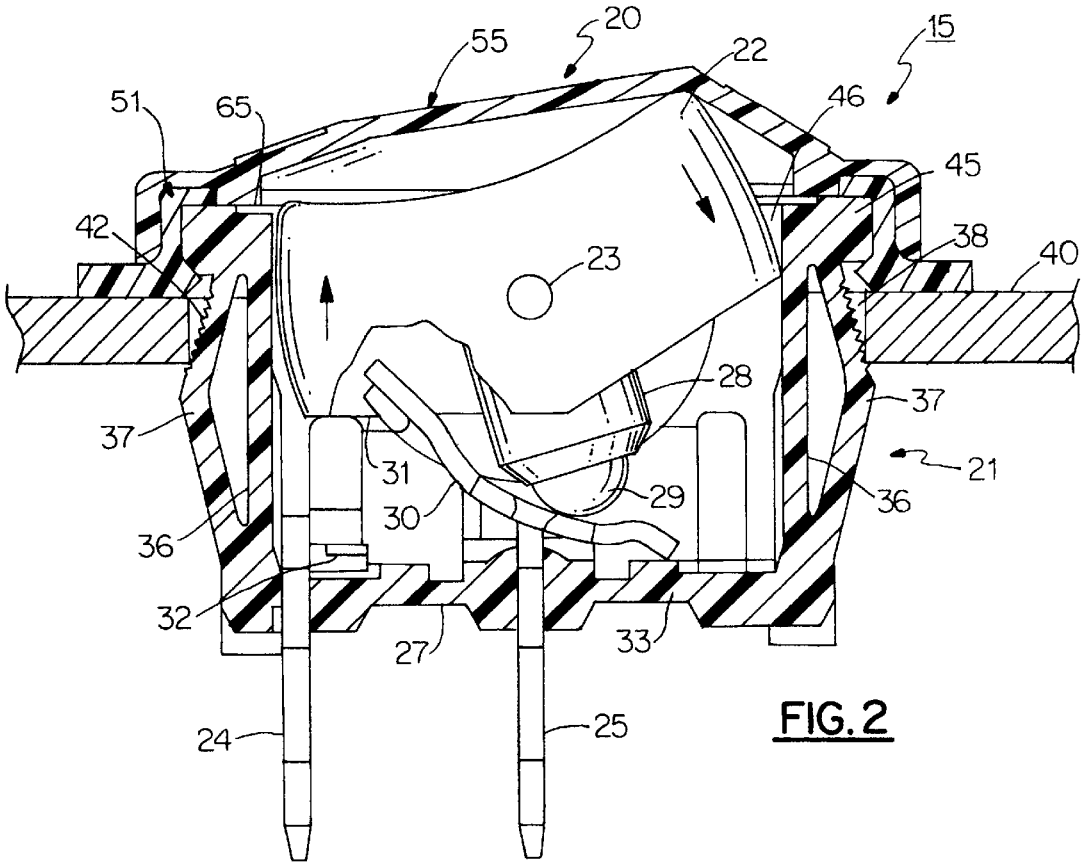
FIG. 2 an enlarged side view, in section, of the switch shown in FIG. 1.

As further illustrated in FIGS. 2–5, the switch 15 is conventional in design having an open top housing 21 in which a rocker arm 22 is arranged to rotate about a pivot 23. A pair of electrical terminals 24 and 25 pass through the floor 27 of this switch housing and are adapted to plug into a suitable receptor in a circuit for bringing electrical power to the tool motor. Alternatively, the terminals may be hard wired and soldered into the power circuit carrying current to the motor. The rocker arm contains a centrally located tubular member 28 in which a ball 29 is contained. The ball is biased by a spring (not shown) into rolling contact against a pivot arm 30. A first contact 31 is mounted upon one end of the pivot arm which is arranged to close against a second contact 32 to provide a path for electrical current to flow between the two terminals 24 and 25. The switch, as illustrated in FIG. 2, is shown in an open position wherein the left hand side of the pivot arm is in a raised position and the ball is positioned to hold the right hand side of the contact arm down against stop 33. Depressing the right hand side of the rocker arm moves the ball toward the opposite end of the pivot arm forcing that end of the arm downwardly so that the first contact pad comes to rest against a second contact pad 33. This, in turn, establishes a current path through the contact arm between the two terminals, closing the switch and energizing the electrical motor.

The opposing sides 36—36 of the switch housing are equipped with flexible outwardly protruding V-shaped tabs 37—37 that are arranged to snap-fit into a receiving opening 38 formed in the casing 40 of the machine handle. The upper surfaces of the tabs are provided with serrations or teeth 42 that lock against the machine casing and prevent the switch from being easily removed from the handle. The upper part of the switch housing further contains a bezel 45 having a rectangular-shaped opening 46 through which the rocker arm moves. The rocker arm protrudes upwardly through the bezel opening so that the position of the arm can be manually changed to cycle the switch between an open and closed position.

The switch is furnished with a protective cover generally referenced 20 that is tightly fitted to the switch housing. The cover includes a relatively rigid rectangular-shaped open frame 51 having opposed vertically disposed side walls 47 and end walls 48. The bottom section of the frame contains an outwardly extended horizontal flange 52 that surrounds the frame. A horizontally disposed lip 53 is carried along the top edge of the frame that extends inward a short distance. The inner wall surfaces of the frame contain a series of elongated V-shaped detents 54—54 that are adapted to snap under the bezel that surrounds the top of the switch to secure the frame to the switch housing. The distance between the detents and the bottom surface of the lip is substantially equal to the width of the bezel. The cover frame is made from a semi-rigid polypropylene.

The frame 51 is covered by a soft flexible plastic cap 55, formed of a material which is marketed under the trade name Santoprene. The cap includes a horizontally disposed rectangular shelf 57 that supports a raised dome 58. The shelf, in turn, is supported upon a vertically disposed skirt having side walls 61 and end walls 62 that extend downwardly along the side walls and end walls of the cover frame. The side walls and end walls of the cap rest in contact upon the lower flange of the cover frame.

The dome of the cover contains a peripheral footing 63 that passes downwardly into the top opening of the frame adjacent to the inside surfaces of the frame's lip. A primary upper seal 65 depends from the peripheral footing and is tightly closed against the top of the bezel when the frame is snap-fitted over the bezel. The seal surrounds the bezel opening and, in assembly, prevents dirt, dust and moisture from passing between the cover and the switch body.

Figure 7:
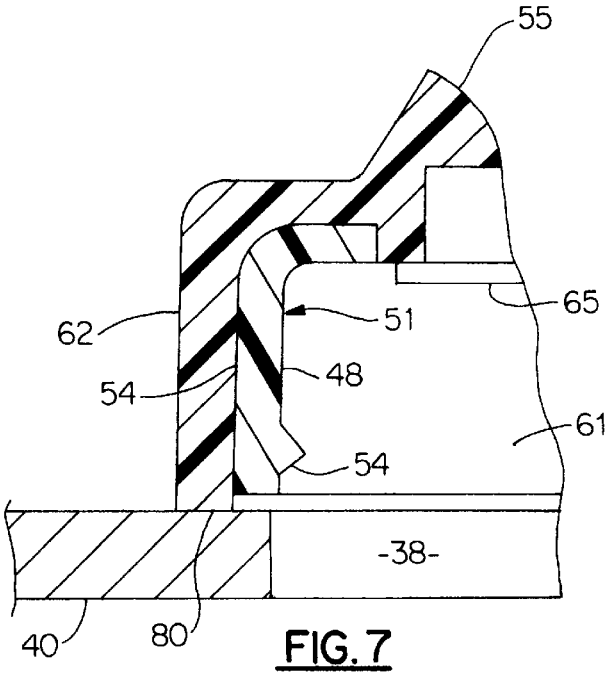
FIG. 7 is a partial sectional view showing a further embodiment of the invention.

The flexible cap 55 is chemically bonded to the cover frame 51 along all contacting surfaces to again prevent dirt and dust from passing between the co-joined two parts. The bond is best depicted in FIG. 7 at line 54. Although chemical bonding is the preferred means of joining the two parts in assembly, any type of seal may be utilized without departing from the teachings of the present invention.

Figure 6:
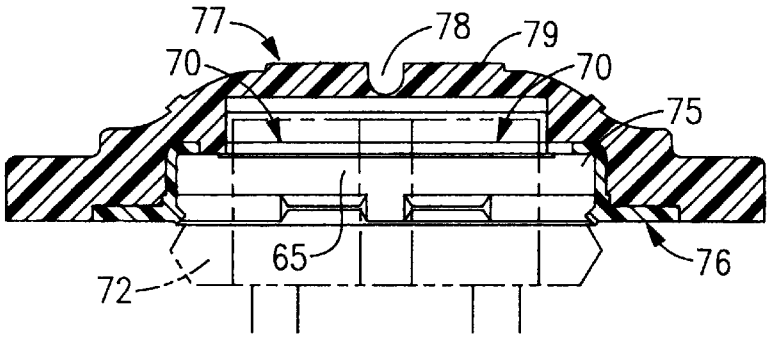
FIG. 6 is a sectional end view showing a further embodiment of present invention for use in association with multiple rocker arm switches.
Figure 5:
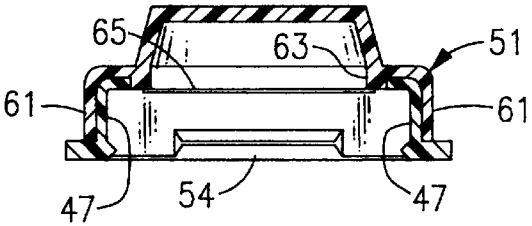
FIG. 5 is a section taken along lines 5—5 FIG. 3.
Figure 3:
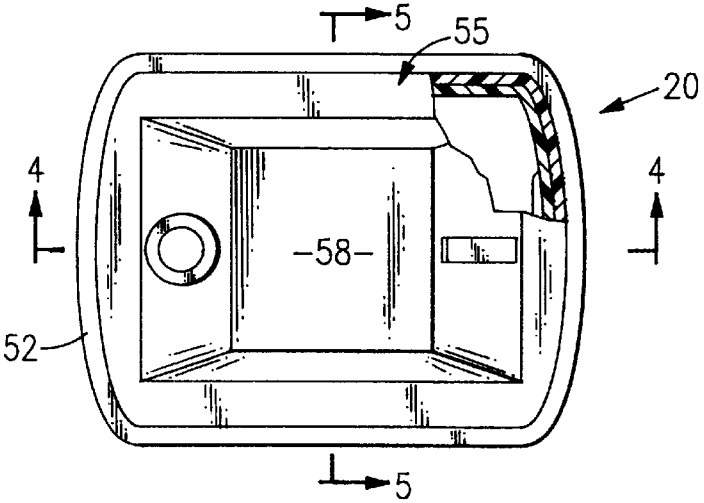
FIG. 3 s a top plane view of the switch.
Figure 4:
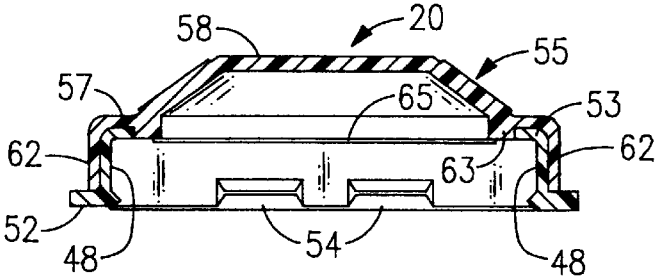
FIG. 4 is a section taken along lines 4—4 in FIG. 3.

Turning now to FIG. 6, there is illustrated a further embodiment of the invention, wherein a pair of rocker arm switches 70 and 71 are mounted in side-by-side relationship within a single switch housing 72. As in the case of the first embodiment described above, the bezel 75 of the switch housing is snap-fitted to the cover 76 of a cover that includes a flexible cap 77 heat-sealed to the frame. The dome 79 of the cap is arranged to pass over the two rocker arms of the switches. A trough 78 is designed to permit one side of the dome to be collapsed, thus cycling the switch located beneath that half of the dome without interfering with the function of the second switch.

Referring now to FIG. 7, there is shown an enlarged partial view in section illustrating a further embodiment of the invention. In this embodiment, the flange 52 of the frame 51 is removed and the side walls 61 and end walls 62 of the cap 55 are extended downwardly below the frame to provide a secondary lower seal 80 that compliments the primary seal 65. Accordingly, when the cover is snap-fitted over the switch bezel, the secondary seal will close against the casing 40 of the power tool to again, more positively protect the switch against dust, dirt and moisture.

While this invention has been explained with reference to the structure disclosed herein, it is not confined to the details set forth and this invention is intended to cover any modifications and changes as may come within the scope of the following claims:

What is claimed is:

1. A cover for protectively enclosing a rocker switch that contains a bezel and a rocker arm that extends upwardly through an opening in said bezel, said cover including, a frame having a central opening, said frame being mountable upon the bezel of a rocker arm switch so that the rocker arm extends upwardly through the opening in said frame, a resilient cap bonded to said frame to provide a dirt proof seal therebetween, said cap passing over the rocker arm of said switch to enclose the frame opening whereby the cap can be depressed to cycle the rocker arm and change the function of the switch, said cap further including a primary seal that is integral with the cap and extends downwardly through the frame opening to surround the bezel opening, said frame further including a plurality of detents that are arranged to snap under the bezel wherein said primary seal is pulled tightly against said bezel whereby dust and dirt are prevented from passing into the switch through the bezel opening.

2. The apparatus of claim 1, wherein said frame is rectangular in form and includes vertically extended side walls and end walls, said frame further including a horizontally disposed flange extending outwardly from the lower periphery of the frame.

3. The apparatus of claim 2, wherein said cap has opposed vertical side walls and end walls, said cap side walls and walls being seated upon the flange of said frame, and being bonded to the frame.

4. The apparatus of claim 2, wherein the vertical distance between said detents and the primary seal is about equal to the width of the bezel.

5. The apparatus of claim 1, wherein a pair of rocker arm switches are mounted in side-to-side relationship inside said bevel and said cap covers both rocker arm switches.

6. The apparatus of claim 5, wherein said cap is dome shaped and includes a trough that extends the length of the cap between the rocker arms wherein the rocker arm of each switch can be cycled independently by collapsing one side or the other of the dome-shaped top.

* * * * *